United States Patent [19]

Chang

[11] 4,177,996

[45] Dec. 11, 1979

[54] AUTOMATIC GOLF BALL TEEING APPARATUS

[76] Inventor: Tommy J. C. Chang, No. 12, Lane 181 Pin Chiang St., Taipei, Taiwan

[21] Appl. No.: 905,873

[22] Filed: May 15, 1978

[51] Int. Cl.[2] ..... A63B 57/00

[52] U.S. Cl. ..... 273/201

[58] Field of Search ..... 273/33, 201, 202, 182 R, 273/191 R; 124/50, 49, 45; 221/298, 289, 301, 292, 293; 198/21, 29; 209/123, 124

[56] References Cited

U.S. PATENT DOCUMENTS

| | | | |
|---|---|---|---|
| 1,940,341 | 12/1933 | Pagett | 273/201 |
| 2,123,195 | 7/1938 | Middleton | 273/201 |
| 2,216,853 | 10/1940 | Middleton | 273/201 |
| 2,285,342 | 6/1942 | MacLellan | 273/201 |
| 2,675,237 | 4/1954 | Willcox | 273/201 |
| 3,003,770 | 10/1961 | Jones | 273/201 |
| 3,127,177 | 3/1964 | Benkoe | 273/201 |
| 3,599,983 | 8/1971 | Melton | 273/201 |
| 3,756,606 | 9/1973 | Land | 273/182 R |

FOREIGN PATENT DOCUMENTS

| | | | |
|---|---|---|---|
| 1510563 | 10/1967 | France | 273/201 |

*Primary Examiner*—Richard C. Pinkham
*Assistant Examiner*—T. Brown
*Attorney, Agent, or Firm*—Howard I. Podell

[57] ABSTRACT

A device for storing and dispensing one golf ball at a time onto a chute that serves as a golf tee. The golf tee chute is pivotally mounted so that when a golf ball on the tee of the chute is struck, the chute pivots to operate an escapement to permit one golf ball, stored in the device to roll down the golf tee chute to the tee position. The device is formed of a housing with a top opening that leads to a spiral pathway formed of wires, which lead to the golf tee chute.

3 Claims, 4 Drawing Figures

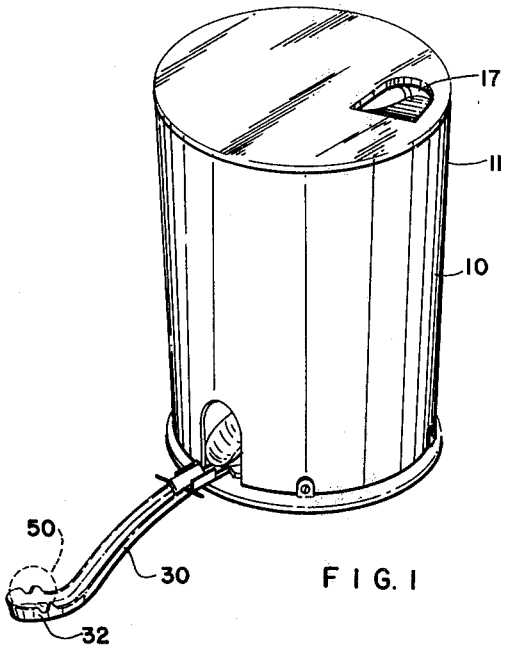
FIG. 1
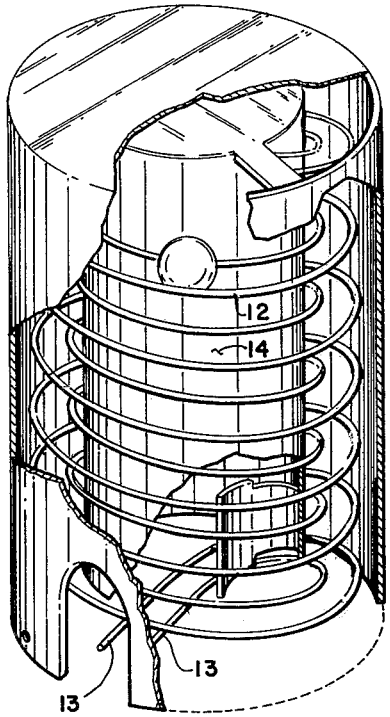
FIG. 2
FIG. 3
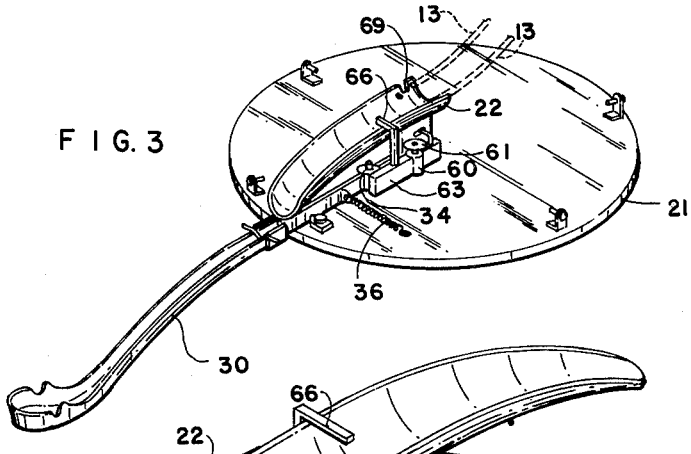
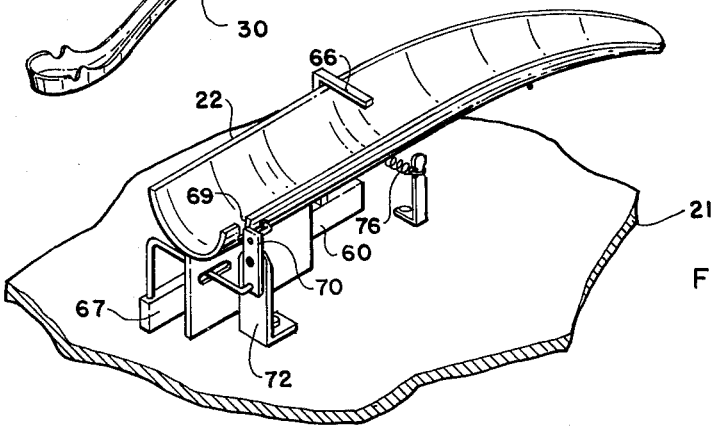
FIG. 4

AUTOMATIC GOLF BALL TEEING APPARATUS

STATEMENT OF THE PRIOR ART

This invention is a device for storing and feeding golf balls to a golf tee chute. Prior art of relevance includes the following U.S. Pat. Nos. 4,017,087; 3,966,213; 3,901,515; 3,599,983; 3,533,631; and 2,838,313.

SUMMARY OF THE INVENTION

My invention is a device for storing and dispensing one golf ball at a time onto a chute that serves as a golf tee. The golf tee chute is pivotally mounted so that when a golf ball on the tee of the chute is struck, the chute pivots to operate an escapement to permit one golf ball, stored in the device to roll down the golf tee chute to the tee position. The device is formed of a housing with a top opening that leads to a spiral pathway formed of wires, which lead to the golf tee chute.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention;

FIG. 2 is a cutaway perspective view of the storage section;

FIG. 3 is a detail perspective view of the golf tee chute and escapement mechanism, taken from the right-hand side of the invention; and FIG. 4 is a detail perspective view of the escapement mechanism taken from the left-hand side of the invention.

DESCRIPTION OF THE PREFERRED EMBODIMENT

Turning now descriptively to the drawings, in which similar reference characters denote similar elements throughout the several views, FIGS. 1–2 illustrate the device 10 which is formed of a cylindrical housing 11 fitted with a top cover opening 17 mounted over a spiral wire track 12 that winds within the housing about a hollow circular wall 14, with the wires 13 of track 12 fastened to brackets extending between wall 14 and outer housing 11.

Housing 11 is fastened to a bottom plate 21 such that spiral track 12 extends to stationary chute 22 so that a golf ball on track 12 will roll onto chute 22 when the housing is assembled to the bottom plate 21, with chute 22 extending downwards.

Stationary chute 22 is fitted with an escapement and extends over golf tee chute 30 that is preferably formed of a rubber material and shaped with a track that extends downward to terminate in a cup shaped section 32 that serves as a golf tee. Golf tee chute 30 is pivotally mounted by vertical pin 34 to bottom plate 21, with spring 36 biasing chute 30 against detent 38. A user who hits a ball 50 resting on the tee cup section 32 will drive the ball off the cup section 32 and will also cause the chute 30 to pivot in the direction away from detent 38 so as to operate the escapement mechanism.

The escapement unit 60 is formed of a lever arm 63 pivoted to plate 21 by a pin 61 with a first end of lever arm 63 bearing against the inner end section of the golf tee chute so as to be pivoted by pivotal motion of chute 30. A projecting member 66 extends over the stationary chute 22 and is joined to first end of lever arm 63, with the opposed end 67 of the lever arm 63 joined by an arm to a pivot member 70 mounted on a vertical bracket 72 with pivot member 70 located so as to extend into a slot 69 in stationary chute when lever arm 63 pivots in the direction to move projecting member 66 away from chute 22, with projecting member 66 and slot 69 spaced apart by the diameter of a golf ball. Thus in the normal position of chute 30, a ball will rest on cup section 32 and a second ball will be on chute 22 resting against member 66 and with additional balls on the spiral track blocked by the said second ball. Upon the striking by the club of the first ball, the chute 30 will pivot to cause lever arm 63 to pivot to cause pivot member 70 to block the balls behind the second ball as projecting member 66 is pivoted away from chute 22 to permit the second ball to freely roll downward in the second chute and continue rolling downwards on the golf tee chute to the tee cup section. As projecting member is biased by spring 76 to the blocking position over chute 22, pivot member 70 is pivoted away from slot 69 to free the passageway for a third ball to roll to the position of the former second ball.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A device for storage and individual dispensing of golf balls, comprising:

A housing, said housing having a vertical spiral track positioned therein, said track having ball entrance and exit ends; an inclined fixed chute, said fixed chute being attached to said housing and positioned at said exit end of said spiral track for receiving golf balls therefrom; an inclined pivot chute, said pivot chute being attached to said housing by pivot means so as to swing in a substantially horizontal plane and for receiving balls from said fixed chute; escapement means attached to said fixed chute to block the path of a golf ball otherwise freely rolling on said fixed chute, said escapement means being linked to said pivot chute to permit one golf ball on said fixed chute to freely roll off said fixed chute and onto said pivot chute and to permit another ball from said spiral track to roll onto said fixed chute, said one ball and said another ball being respectively simultaneusly released from and retained onto said fixed chute in response to said pivot chute being swung about said pivot means; said pivot chute having means at its lower end for retaining a golf ball in position to be hit by a player.

2. the combination as recited in claim 1, in which said means at the lower end of said pivot chute is formed in the shape of a cup

3. The combination as recited in claim 2, in which the pivot chute is formed of a resilient material so as to permit a user to strike a ball, retained in the cup, with a golf club.

* * * * *